US006840663B2

(12) United States Patent
Kao

(10) Patent No.: US 6,840,663 B2
(45) Date of Patent: Jan. 11, 2005

(54) PANEL BRANCH FOR AN ARTIFICIAL TREE

(75) Inventor: Cheung Chong Kao, Chai Wan (HK)

(73) Assignee: Boto (Licenses) Limited, Douglas (GB)

( * ) Notice: Subject to any disclaimer, the term of this patent is extended or adjusted under 35 U.S.C. 154(b) by 8 days.

(21) Appl. No.: 10/419,556

(22) Filed: Apr. 22, 2003

(65) Prior Publication Data

US 2004/0213019 A1 Oct. 28, 2004

(51) Int. Cl.[7] ..... A41G 1/00; A47G 33/00; F21V 7/04

(52) U.S. Cl. ..... 362/568; 362/554; 362/565; 362/123; 362/806; 211/205

(58) Field of Search ..... 362/568, 567, 362/554, 556, 565, 123, 806; 428/17, 18; 248/220.31, 225.21, 220.22; 211/205, 196

(56) References Cited

U.S. PATENT DOCUMENTS

| | | | | |
|---|---|---|---|---|
| 2,674,147 A | | 4/1954 | Franklin | |
| 3,042,350 A | | 7/1962 | Lencioni | |
| 4,895,339 A | | 1/1990 | Yang et al. | |
| 5,255,886 A | | 10/1993 | Wang | |
| 5,517,390 A | * | 5/1996 | Zins | 362/568 |
| 5,647,569 A | | 7/1997 | Sofy | |
| 5,713,554 A | | 2/1998 | Lai | |
| 5,921,022 A | | 7/1999 | Baker | |
| 6,056,427 A | * | 5/2000 | Kao | 362/581 |
| 6,320,327 B1 | | 11/2001 | Lavatelli | |
| 6,458,435 B1 | | 10/2002 | Lai | |

* cited by examiner

*Primary Examiner*—Stephen Husar
*Assistant Examiner*—Sharon Payne
(74) *Attorney, Agent, or Firm*—G. Brian Pingel; Camille L. Urban

(57) ABSTRACT

The panel branch disclosed is used with an artificial tree. The panel branch includes a plurality of twigs, a channel element, a number of inserts, and a hook-like member. Each twig is inserted through an aperture in the insert and the insert, in turn, is placed in and secured in the channel element. The hook-like member has a short side used to secure the branch to an artificial trunk and a long side secured in the channel element. Optical fibres are associated with the twigs of the panel branch. Each optical fiber is threaded through an aperture in an insert and gathered into a bundle. A socket with a light source is provided to receive the bundle of optical fibres such that the branch is lighted.

19 Claims, 5 Drawing Sheets

PANEL BRANCH FOR AN ARTIFICIAL TREE

BACKGROUND OF THE INVENTION

1. Field of the Invention

The present invention relates in general to an artificial tree and, more specifically, to a panel branch wherein a group of branches are associated together and can be attached to a trunk member as a unit.

2. Description of the Prior Art

It is known in the art to provide artificial trees. Such artificial trees are of differing construction and assembly methods. Some are available pre-assembled with branch members pre-attached to trunks and twigs pre-attached to branch members. Because these trees are pre-assembled, they can be more easily and quickly erected than trees which are not pre-assembled. Some of these trees may come with pre-positioned lighting, as well. Although some of the pre-assembled artificial trees just described collapse for storage, they can collapse only to a certain degree; the larger trees constructed in this manner require a relatively large storage space.

Other artificial trees are available completely unassembled and require each twig to be screwed in to or otherwise attached to each branch member and, then, each branch member to be associated on an individual basis with the trunk. Some are partially assembled such that the twigs are pre-associated with the branch members, but each branch member must then be associated manually on an individual basis with the trunk. Many artificial trees assembled in this manner are somewhat unstable or unsightly due to the number of fasteners required. In addition, unassembled trees pose a problem for pre-positioned lighting in that providing electrical or another source of light which is pre-positioned relative both to lighting or power source and to the branches of the tree is difficult. However, these partially or wholly unassembled trees require less storage space.

The present invention differs from the above referenced inventions and others similar in that the present invention conserves storage space needs and simplifies assembly procedures. In addition, one embodiment of the present invention includes associating optical fibres with the twigs and trunk to provide fibre optic illumination. The present invention provides for this association of optical fibres with said twigs while maintaining ease of assembly, minimizing storage space, and promoting an attractive appearance.

SUMMARY

The present invention provides a number of panel branches rather than single branches to be associated with a trunk of an artificial tree. The panel branch comprises a plurality of inserts with which are associated bendable twig members. Each insert is then placed in and secured in a channel member. The panel branch also includes a means to attach said panel branch to said trunk. Therefore, by associating a number of panel branches with said trunk, an artificial tree is more, simply assembled than associating each single branch and/or twig. Each panel branch can be stored essentially flat and, upon assembly, the twigs bent to resemble a more realistic and three-dimensional branch.

In one embodiment, optical fibres are associated with the twig members of each said panel branch. The optical fibres are provided a light source via a connection with the trunk and are camouflaged so as to maintain a more realistic appearance of the artificial tree.

Other objects, features, and advantages of the present invention will be readily appreciated from the following description. The description makes reference to the accompanying drawings, which are provided for illustration of the preferred embodiment. However, such embodiment does not represent the full scope of the invention. The subject matter which the inventor does regard as his invention is particularly pointed out and distinctly claimed in the claims at the conclusion of this specification.

DESCRIPTION OF THE PREFERRED EMBODIMENT(S)

Figure 1:
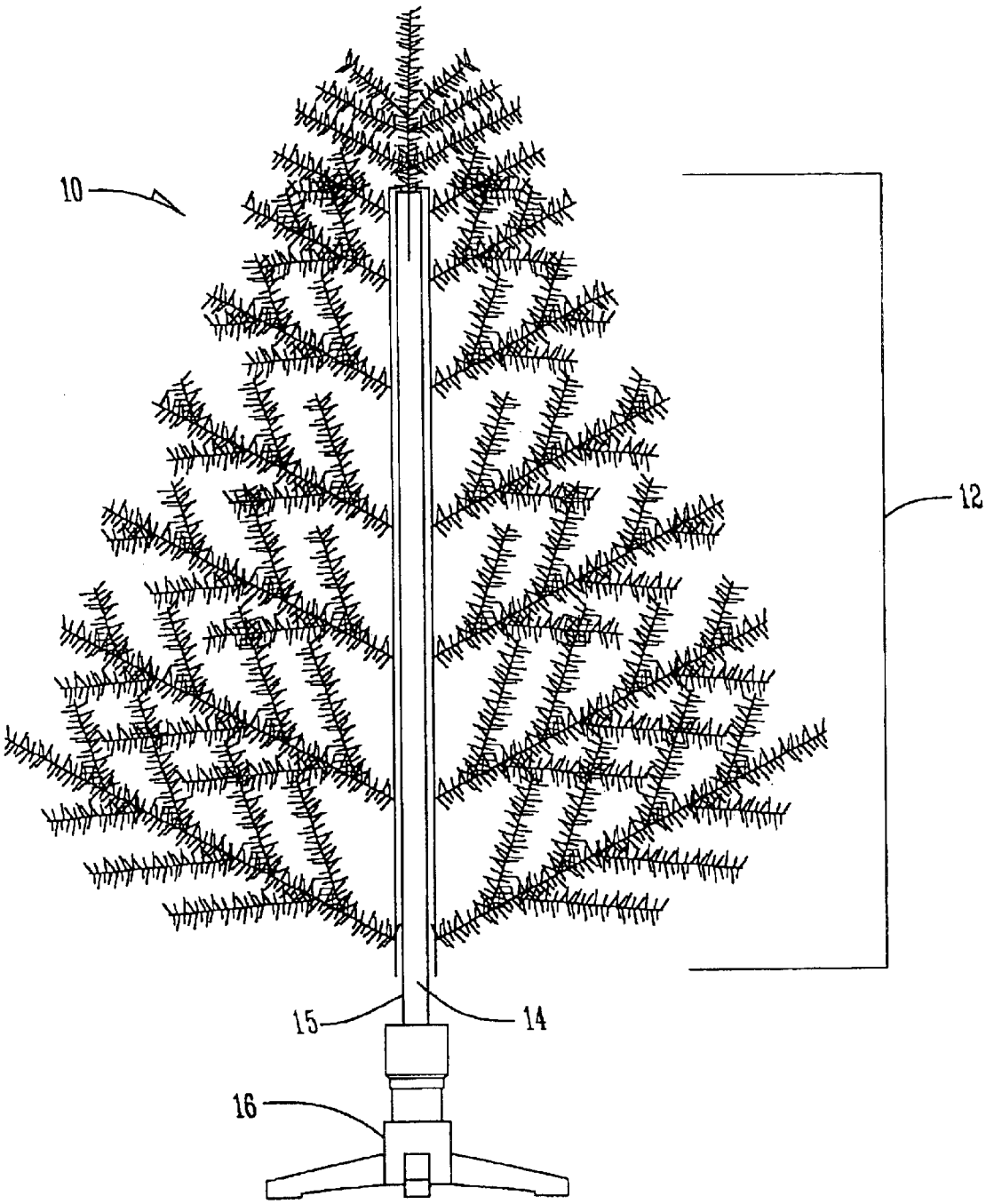
FIG. 1 is a perspective view of the preferred embodiment of an artificial tree and a plurality of panel branches of the present invention.

An artificial tree is shown generally as 10 in FIG. 1 embodying a plurality of panel branches 12 of the present invention. Said tree 10 comprises a trunk member 14 with an outside surface 15, a stand assembly 16, and a plurality of panel branches 12. Each of said panel branches 12 comprises a plurality of twig members 20, at least one insert 22, and a channel element 26 with a top end 27.

Figure 2:
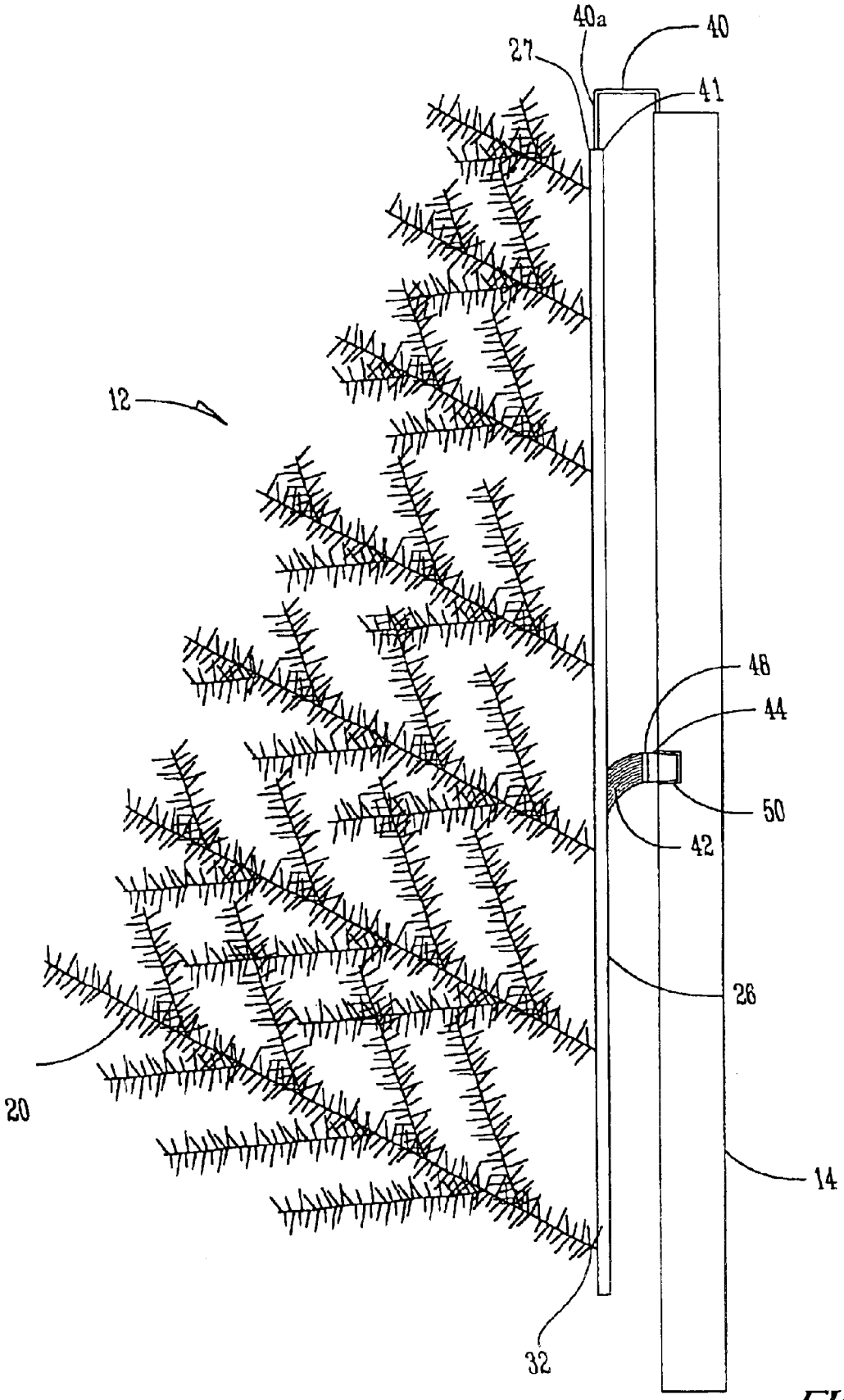
FIG. 2 is an enlarged perspective view of one of the panel branches and the trunk member of the artificial tree of FIG. 1.
Figure 3:
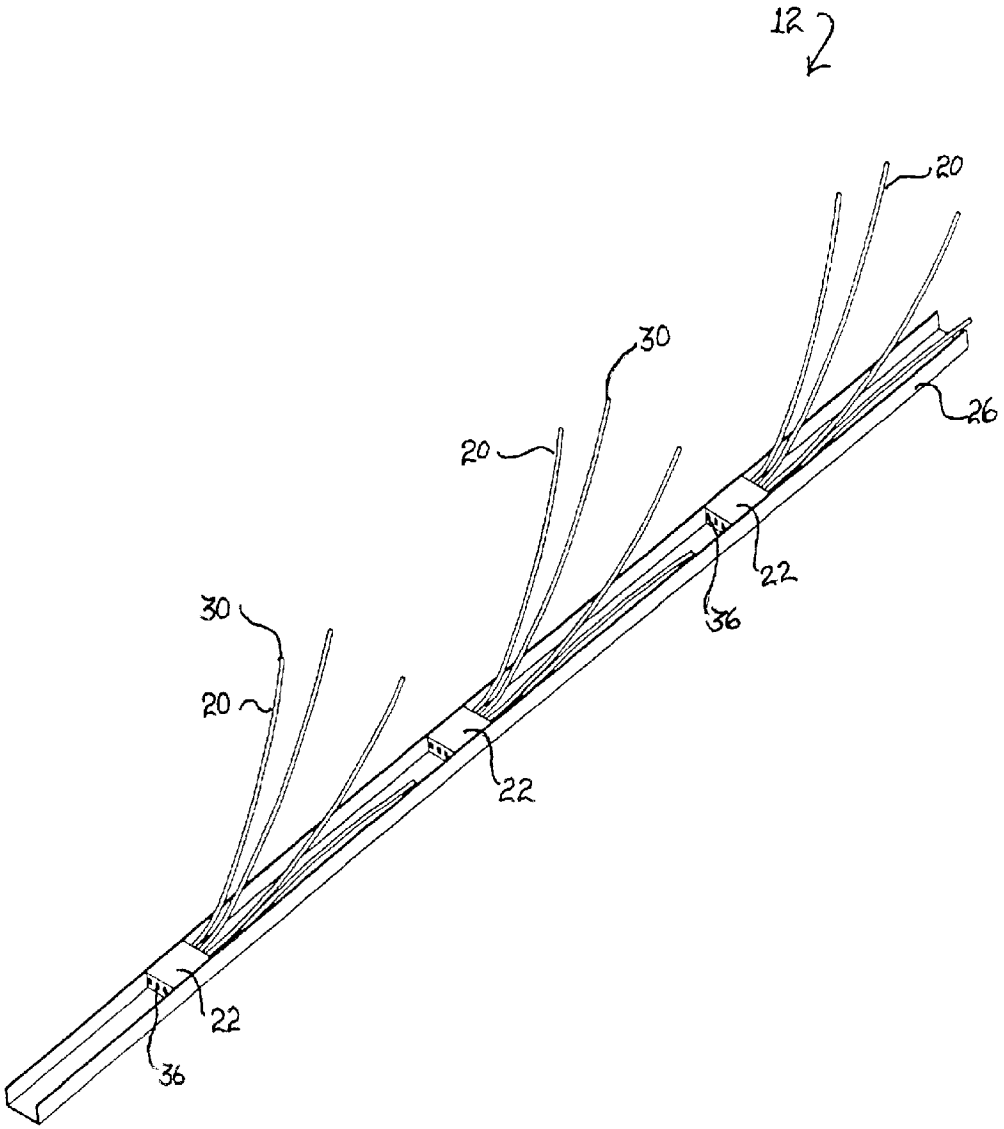
FIG. 3 is a perspective view of a channel element and a plurality of inserts for associating twigs and optical fibers of the panel branch.
Figure 4:
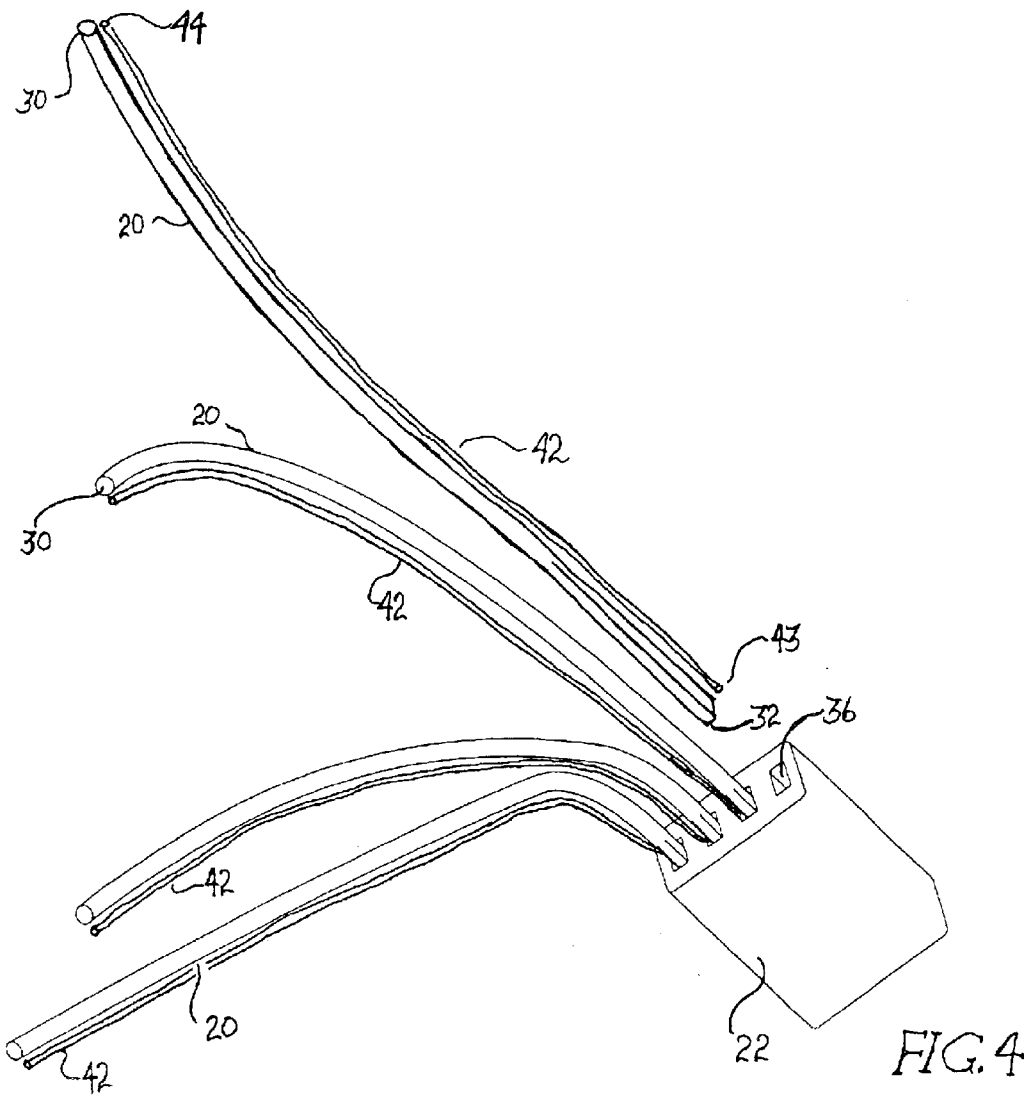
FIG. 4 is an enlarged perspective view of the insert and twigs of FIG. 3.

As shown in greater detail in FIG. 2, each of said plurality of twig members 20 comprises a distal end 30 and a proximal end 32. Means for associating said twig members 20 with said channel element 26 comprise a plurality of apertures 36 in said at least one insert 22. Referring no to FIGS. 3 and 4, at least one of said proximal ends 32 of said twig members 20 is inserted in each of said apertures 36. In the preferred embodiment said proximal ends 32 of twig members 20 are shaped complementarily to each of said plurality of apertures 36 in said insert 22 to restrict said twigs from turning. In this embodiment, means for associating said twig members 20 with said at least one insert 22 includes friction fitting of the proximal ends in said apertures. As an additional measure of secure association of said twigs, an adhesive material may be placed in each of said apertures 36 prior to the insertion of the proximal ends 32.

Figure 5:
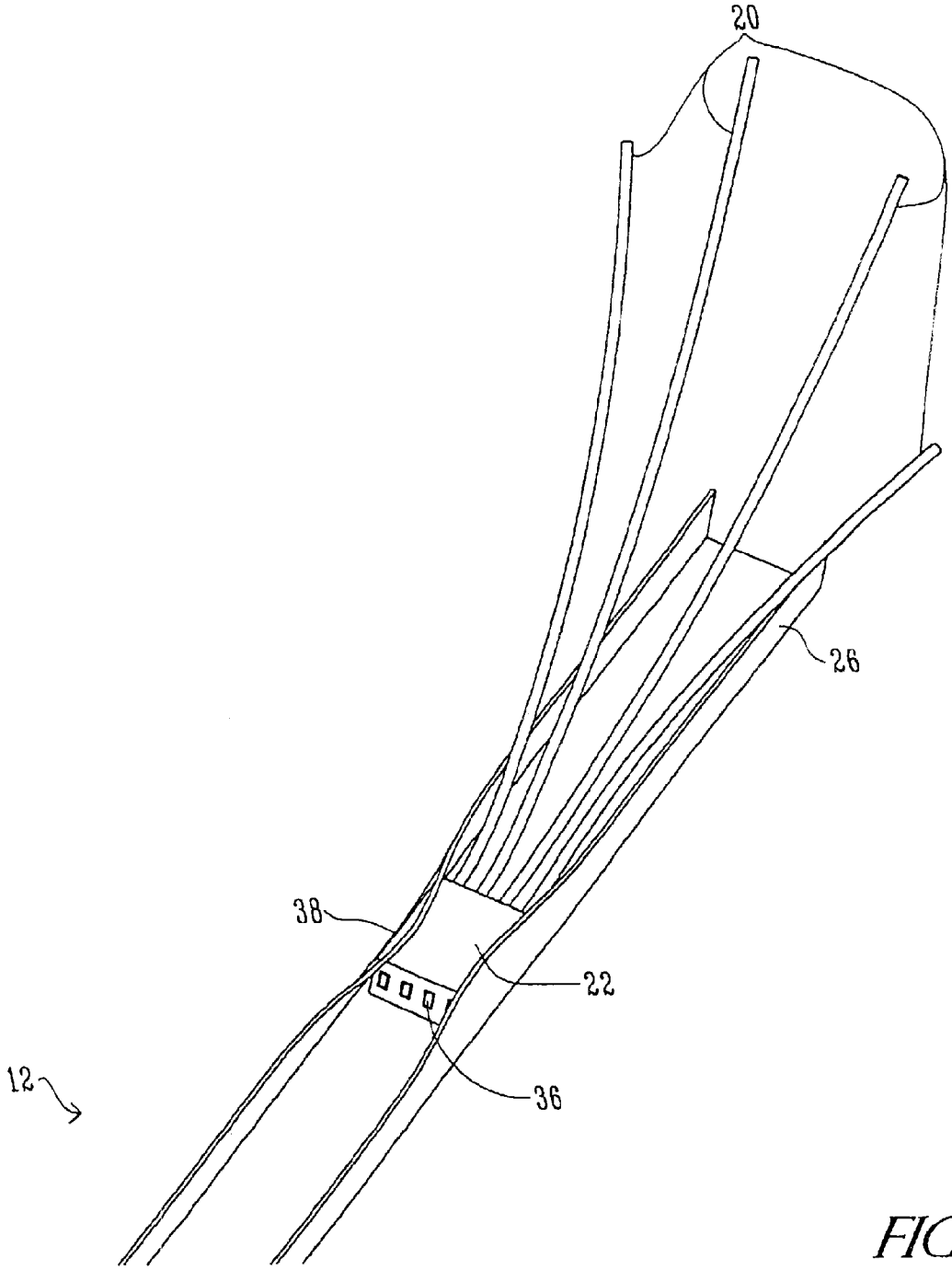
FIG. 5 is an enlarged perspective of the insert and a first crimped portion of said channel element.

Said channel element 26 is large enough to substantially surround said at least one insert 22. Each of said inserts 22 is placed in said channel element 26 such that said distal ends 30 of said twig members 20 protrude from said channel element 26. Means for securing said at least one insert 22 within said channel 26 comprise at least one crimped portion 38 as shown best in FIG. 5.

Means are provided for attaching each said panel branch 12 to the trunk 14. In the preferred embodiment, said means comprise a hook-like member 40 with an elongated side **40*a* which is inserted into said top end 27 of said channel member 26 and secured with a compressed portion 41 of said channel element 26**.

Finally, in a finished version of the preferred embodiment and shown best in FIG. 4, with each panel branch 12 is associated a plurality of optical fibres 42 each with a first end 43 and a second end 44 which are further associated with said twig members 20 and said channel element 26 said first ends 43 of each of said plurality of optical fibers 42 is threaded through one of said plurality of apertures 36 in said at least one insert 22. Means to detachably associate said optical fibres with said trunk 46 are provided. Said means to detachably associate said optical fibres with said trunk comprises a bundling part 48 associated with said channel element 26 and into which are gathered the first ends 43 of said optical fibres 42 and a socket 50 on said outside surface 15 of said trunk member 14 to which light is provided. The bundling part 48 on said channel element 26 fits into said socket 50 on said trunk member 14 and can be disassociated when the tree is disassembled. Said second ends 44 of said optical fibres 42 may be provided with camouflaging means such that said optical fibres 42 are not readily, visually apparent on the assembled tree 10.

Thus, the present invention has been described in an illustrative manner. It is to be understood that the terminology that has been used is intended to be in the nature of words of description rather than of limitation.

Many modifications and variations of the present invention are possible in light of the above teachings. For example, said panel branches may all be of similar length and size such that said hook-like members are inserted in an opening at the top of said tree or, in the alternative, panel branches may be of differing lengths and apertures provided for the hook-like members at different places on the tree. The light source for the optical fibres may be generated at the base of the tree and transmitted up the trunk or there may be provided more than one light source located at different positions of the tree. Therefore, within the scope of the appended claims, the present invention may be practiced otherwise than as specifically described.

What I claim is:

1. An artificial tree comprising:

a) a stand assembly;

b) a trunk member;

c) a plurality of panel branches each comprising a plurality of twig members, and a channel element, and means to associate said plurality of twig members with said channel element;

d) each of said plurality of twig members comprising a proximal end and a distal end; and e) means to associate each of said plurality of panel branches with said trunk member.

2. An artificial tree as claimed in claim 1 wherein said channel element of each of said plurality of panel branches is "U" shaped.

3. An artificial tree as claimed in claim 1 wherein said means to associate each of said plurality of panel branches with said trunk member comprises a hook-like member with one elongated side wherein said elongated side is secured in said channel element.

4. An artificial tree as claimed in claim 3 wherein said means to associate each of said panel branches with said trunk member further comprises a single aperture in said trunk into which all hook-like members are insertable.

5. An artificial tree as claimed in claim 1 wherein said means to associate said plurality of twig members with said channel element comprises:

a) at least one insert;

b) a plurality of apertures in each of said at least one insert;

c) the proximal end of at least one said twig member is inserted in each of said plurality of apertures; and d) at least one crimped portion of said channel element to secure said insert therein.

6. An artificial tree as claimed in claim 4 further comprising means to secure said proximal ends of said twigs in said plurality of apertures in at least one insert.

7. An artificial tree as claimed in claim 6 wherein said means to secure said proximal ends of said twigs in said plurality of apertures comprises said proximal ends shaped complementarily to said apertures.

8. An artificial tree as claimed in claim 1 further comprising means to secure said proximal ends of said twigs in said at least one insert and wherein said means to associate said twig members with said channel member comprise a crimped portion of said channel member in which at least one insert is placed.

9. An artificial tree as claimed in claim 1 wherein said means to associate said plurality of twig members with said channel elements comprise an insert with a plurality of apertures therethrough, said insert secure within said channel element and further comprising:

a) a light source;

b) a plurality of optical fibres each with a first end and a second end wherein each said second end is associated with one of said plurality of twig members and each said first end is threaded through one of said plurality of apertures in said insert; and d) means for detachably associating each said first end of each of said plurality of optical fibres with said trunk and said light source.

10. An artificial tree as claimed in claim 9 wherein said means for detachably associating said first ends of said optical fibres with said trunk member comprises a bundling part mounted on said channel element into which said first ends of said optical fibres are gathered and a socket-like member associated with said trunk member to which light from said light source is provided.

11. A panel branch for an artificial tree comprising:

a) a hook-like member with an elongated side for associating said panel branch with an artificial trunk member;

b) a "U" shaped channel element;

c) a plurality of twig members each comprising a proximal end and a distal end;

d) said elongated side of said hook-like member inserted in a top end of said channel element; and e) means to associate each of said twig members with said channel element.

12. A panel branch as claimed in claim 11 wherein said means to associate each of said twig members with said channel element comprises at least one insert with a plurality of apertures wherein said proximal ends of said twig members are inserted in said plurality of apertures, said proximal ends are shaped complementarily to said apertures to restrict said twigs from turning, and said at least one insert is secured in said channel element.

13. A panel branch as claimed in claim 12 wherein said means to associate each of said twig members with said channel element further comprises a crimped portion of said channel element tightly securing said at least one insert.

14. A panel branch as claimed in claim 12 further comprising:

a) a plurality of optical fibres associated with each said panel branch and wherein each of said optical fibres comprises a first end and a second end; and b) said second ends are associated with said twig members of said panel branch, said first ends are gathered and secured into a bundling part mounted on said channel element, and said bundling part is detachably mated to a socket-like member on said artificial trunk member.

15. An artificial tree comprising:

a) a trunk member with an outside surface;

b) a plurality of panel branches each comprising a plurality of twig members and a channel element;

c) each said twig member comprising a proximal end and a distal end;

d) means to associate each of said plurality of twig members with said channel element comprising at least one insert, a plurality of apertures in said at least one insert, each of said proximal ends of said twig members inserted into one of said plurality of apertures, and said at least one insert secured in said channel element;

e) means to associate each of said plurality of panel branches with said trunk member wherein said means comprise a hook-like member with one elongated side secured in said channel element and at least one aperture in said outside surface of said trunk member; and f) said trunk member, said plurality of twig members, and said channel element are provided means for generating the appearance of natural tree parts.

16. An artificial tree as claimed in claim 15 wherein said outside surface of said trunk member comprises at least one socket which is associated with a light source.

17. An artificial tree as claimed in claim 16 wherein said artificial tree further comprises a plurality of optical fibres each with a first end and a second end, said first ends gathered in a bundling part, said bundling part inserted in said at least one socket associated with said light source, and said second ends of said plurality of optical fibres associated with said twig members.

18. An artificial tree as claimed in claim 15 wherein wherein the means for generating the appearance of natural tree parts comprises artificial greenery.

19. An artificial tree as claimed in claim 15 wherein said channel element comprises metal and said at least one insert and said hook-like member are secured in said channel-element by at least one crimped portion of said channel element.

* * * * *